United States Patent [19]

Wakefield et al.

[11] Patent Number: 4,582,414

[45] Date of Patent: Apr. 15, 1986

[54] MAGNETIC BRUSH DEVELOPMENT APPARATUS

[75] Inventors: Edward H. Wakefield; James W. Consaul, both of Rochester, N.Y.

[73] Assignee: Eastman Kodak Company, Rochester, N.Y.

[21] Appl. No.: 605,963

[22] Filed: May 1, 1984

[51] Int. Cl.[3] ..... G03G 15/00

[52] U.S. Cl. ..... 355/3 DD; 222/DIG. 1; 118/657; 118/658

[58] Field of Search ..... 355/3 DD, 3 R; 222/DIG. 1; 118/656, 657, 658

[56] References Cited

U.S. PATENT DOCUMENTS

| | | | |
|---|---|---|---|
| 3,664,299 | 5/1972 | Shaler . | |
| 3,724,725 | 4/1975 | Stauffer . | |
| 3,825,936 | 7/1974 | Ott et al. . | |
| 4,060,105 | 11/1977 | Feldersen . | |
| 4,101,211 | 7/1978 | Kayson . | |
| 4,168,901 | 9/1979 | Ito et al. . | |
| 4,173,405 | 11/1979 | Swapceinski . | |
| 4,354,763 | 10/1982 | Koiso et al. | 355/3 DD |

FOREIGN PATENT DOCUMENTS

| | | | |
|---|---|---|---|
| 0030837 | 3/1979 | Japan | 355/3 DD |

OTHER PUBLICATIONS

Research Disclosure 16677, Feb. 1978, entitled "Developer Distribution Apparatus".

Research Disclosure 17512, Nov. 1978, entitled "Magnetic Brush Development Station".

*Primary Examiner*—A. C. Prescott

*Assistant Examiner*—David Warren

*Attorney, Agent, or Firm*—William F. Noval

[57] ABSTRACT

Magnetic brush development apparatus for use in reproduction apparatus in which a support carrying a developable latent image is moved through a development zone which is transversely inclined at a predetermined angle to the horizontal. The development apparatus includes a stationary non-magnetic inclined applicator with a segment located adjacent to the development zone. The applicator is supplied with magnetic developer which is distributed over the surface of the applicator through the influence of gravity and of a magnet assembly rotatably mounted within the applicator. A reservoir associated with the applicator accumulates developer moved about the periphery of the applicator and levels it to produce a uniformly thick layer in the development zone. A transport assembly is positioned at the inlet to the reservoir to transport excess developer from the reservoir back up the applicator against the influence of gravity to deposit developer in the reservoir in areas which are deficient in developer and to remove excess developer from the applicator at the upper end thereof when the reservoir is full.

13 Claims, 8 Drawing Figures

MAGNETIC BRUSH DEVELOPMENT APPARATUS

BACKGROUND OF THE INVENTION

This invention relates generally to apparatus for developing latent images with particulate developer. More particularly, this invention relates to magnetic brush development apparatus for developing a latent image carried by a support which is passed through a development zone which is inclined at a predetermined angle to the horizontal.

In electrography, it is common to form an electrostatic image on an electrophotographic member such as a drum, web or sheet and to develop that image by applying developer particles thereto. The developed image is either transferred to a receiving member and fixed to such member or is fixed to the electrophotographic member itself.

The electrostatic image may be developed by means of a non-magnetic cascade system or by means of magnetic systems with either single component or two-component magnetic magnetic developer. In two-component development systems, the developer includes magnetic carrier particles and toner particles which are electrostatically attached to the carrier either by electrostatic charging or by triboelectric charging. In such systems, the magnetic carrier particles are held to a non-magnetic applicator surface in a bristle formation by a magnetic assembly located within the applicator. Either the magnet or the applicator rotates to brush the surface of a member carrying an electrostatic image. The electrostatic image is developed by the attraction between the toner and the charged image which overcomes the electrostatic attraction between the magnetic particles and the toner. In single-component development systems, the magnetic particle itself is attracted to the electrostatic image for development. If the magnetic particles are insulating, they are electrostatically charged so that they are attracted to the electrostatic to develop it. Alternatively, if the magnetic particles are relatively conductive, they are attracted to the electrostatic image by means of a charge induced by an electrical potential applied between the electrostatically charged surface and an electrically conductive applicator.

Some magnetic brush development apparatus include a sump which extends the length of the development zone and which contains the magnetic developer. The magnetic brush transports developer from the sump to the development zone and back to the sump. There is a tendency in such apparatus for toner to settle at the bottom of the sump causing loss of usable developer and requiring more frequent replenishment than should be necessary. In single-component magnetic developer apparatus, a magnetic brush applicator may be supplied with magnetic developer by means of a hopper which extends the length of the applicator. The rate at which developer is supplied to the applicator should equal the rate at which it is carried off by developed supports to avoid waste of developer. Otherwise, since developer is usually not recirculated in hopper-type apparatus, a waste container must be provided resulting in costly and inefficient use of developer. In hopper-fed apparatus, there is also a tendency for developer to cake up between the hopper outlet and developer applicator causing uneven application of developer to a support and consequent image defects. In both sump and hopper-fed development apparatus, developer is supplied across the length of the applicator and developer does not tend to move laterally along the applicator due to the influence of gravity since the applicator is generally horizontally oriented. However, electrographic reproduction systems may be used with a microfilm reader-printer which is inclined to the horizontal in order to provide for operator convenience in viewing and operation. In such apparatus, the development zone of electrographic printer is transversely inclined at a predetermined angle to the horizontal and development apparatus which used sumps or hoppers to supply developer would be inadequate due to the tendency of the developer to accumulate at the lower end of the development apparatus due to the influence of gravity.

SUMMARY OF THE INVENTION

In accordance with the present invention, there is provided magnetic brush development apparatus wherein a support carrying a latent image which is moved through a development zone which is transversely inclined at a predetermined angle to the horizontal is developed uniformly across the development zone. Developer is moved freely through the development apparatus without becoming compacted and without clogging the apparatus. Recycling of unused developer is cost effective.

According to the magnetic brush development apparatus of the present invention, a stationary, nonmagnetic applicator is provided having a segment located adjacent to a development zone and oriented at a predetermined angle to the horizontal. The development apparatus includes means for supplying magnetic developer to said applicator at a supply zone thereof spaced from said development zone. Magnet means are rotatably mounted within said applicator and cooperatively associated with said supplying means for moving said magnetic developer around the periphery of said applicator through said development zone so that developer is distributed over the surface of the applicator through the influence of said rotating magnet and through the influence of gravity.

Reservoir means are provided associated with said applicator and located between said supply zone and said development zone for accumulating developer moved along said applicator and for leveling the developer to produce a uniformly thick developer layer in said development zone. Means cooperating with said applicator and positioned between said reservoir means and said supply zone transports excess developer from said reservoir means back up said applicator against the influence of gravity to deposit developer in said reservoir means in areas which are deficient in developer and to remove excess developer from said applicator at the upper end thereof when the reservoir means is full.

According to an aspect of the invention, the applicator is electrically conductive and the means for supplying developer supplies relatively electrically conductive single-component magnetic developer to said applicator such that a support carrying a latent electrostatic image moved through said development zone is electrically connected to said applicator to effect development of said electrostatic image by said developer.

The invention and its objects and advantages will become more apparent in the detailed description of the preferred embodiment presented below.

BRIEF DESCRIPTION OF THE DRAWINGS

In the detailed description of the preferred embodiments of the invention presented below, reference is made to the accompanying drawings like elements having like numbers in which.

DESCRIPTION OF THE PREFERRED EMBODIMENT

Figure 1:
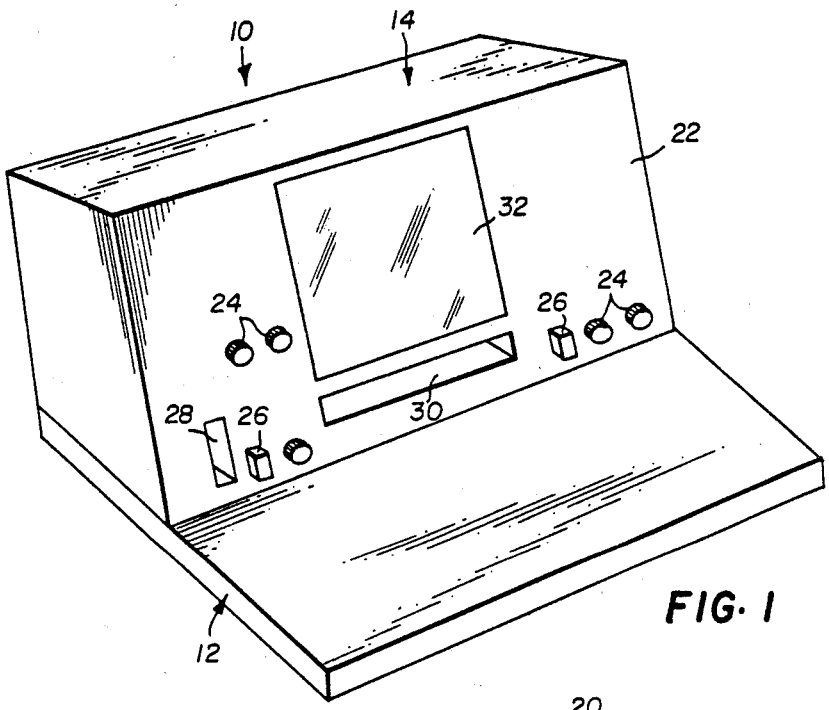
FIG. 1 is a schematic perspective view of microfilm reader-printer apparatus in which the magnetic brush development apparatus of the present invention may be used.
Figure 2:
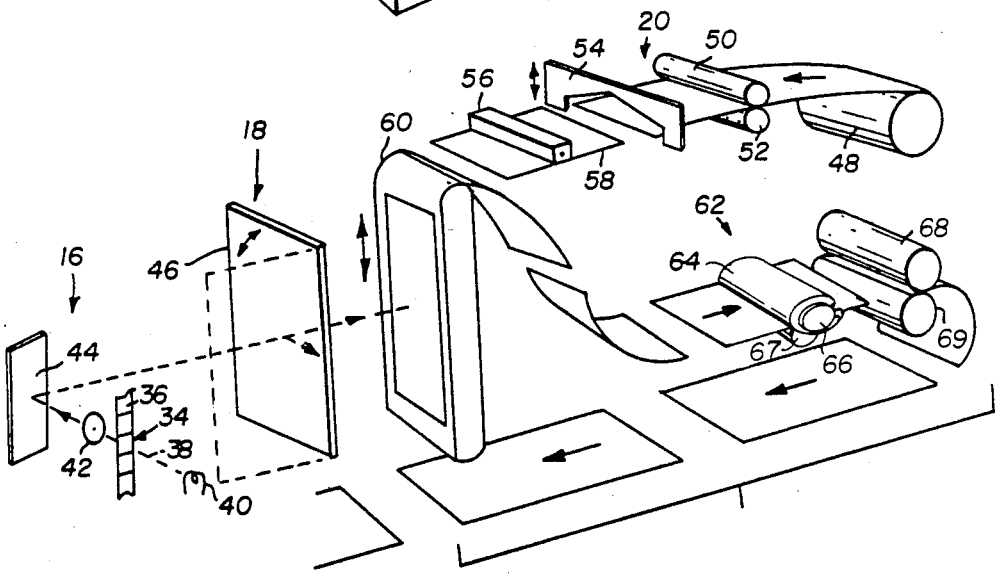
FIG. 2 is a diagrammatic perspective view of the internal assemblies of the apparatus of FIG. 1.

Although the magnetic brush development apparatus of the present invention may be used with any type of reproduction apparatus, the development apparatus is particularly useful in apparatus which is transversely inclined at a predetermined angle to the horizontal. An example of such apparatus is the STARVUE Reader sold by the Eastman Kodak Company (Rochester, N.Y.). This reader is inclined in its cabinet at an angle of about 10° to the horizontal for ease of viewing and operation by an operator. The cabinet may be mounted on a work table which has a surface which is inclined about 10° to the horizontal so that the microfilm reader is inclined a total of 20° to the horizontal. An electrographic printer module used in conjunction with such a reader to produce enlarged prints from microfilm images would also have its components inclined to the horizontal. An exemplary microfilm reader with an electrographic printer module is illustrated in FIGS. 1 and 2. As shown, apparatus 10 is mounted on a work table 12 and includes a cabinet 14 which has a microfilm projection and transport assembly 16 located in the left-hand portion thereof; an image display and print delivery assembly 18 located in the central portion; and an electrographic printer assembly 20 located in the right-hand portion of cabinet 14.

Assemblies 16, 18 and 20 are inclined at an angle of about 10° to the horizontal within cabinet 14 and cabinet 14 is mounted on surface 13 of table 12 which is also inclined about 10° to the horizontal. Thus, assemblies 16, 18 and 20 are transversely inclined about 20° to the horizontal. Mounted on the front wall 22 of cabinet 14 are several control knobs 24 and buttons 26 for controlling the functions of projection and transport assembly 16 and printer assembly 20. Such controls, for example, are provided for manually controlling direction and speed of film movement during viewing, for focusing images projected from the microfilm, for switching power on and off, for printing, etc. Front panel 22 also includes a film receptacle slot 28 for receiving a cartridge of microfilm a print delivery receptacle 30 from which finished prints are removed by the operator and a display screen 32 onto which enlarged microfilm images are projected for viewing.

As shown in FIG. 2, microfilm 34 includes a plurality of image frames 36 which are selectively positioned to intersect light projected along axis 38 from light source 40. Film 34 is supplied from a reel or cartridge of film inserted into slot 28 and taken up by a takeup reel (not shown). The microfilm image is projected by lens 42 along axis 38 and reflected off lens mirror 44 either to be displayed upon screen 32 after reflection from screen mirror 46 (when mirror 46 is in the position shown in solid lines in FIG. 2) or to be reproduced by print assembly 20 (when mirror 46 is in the position shown in dotted lines in FIG. 2).

Print assembly 20 includes a supply of photoconductive material in the form of a roll 48 which is convenient for providing prints of differing lengths depending upon the size of the image recorded on microfilm 34. It will be understood that a supply of precut sheets of photoconductive material may be provided either in addition to or in lieu of roll 48.

Metering rolls 50 and 52 meter out a preselected length of photoconductive material in accordance with a control setting by the operator. As the length of material is metered out it passes under corona charger 56 which deposits an electrostatic charge thereon. Reciprocating knife 54 then severs a cut sheet 58 from the roll. Sheet 58 is transported onto vacuum platen 60 which positions the photoconductive material for exposure to a radiation image directed along axis 38 from microfilm 34, thus forming a latent electrostatic image corresponding to the microfilm image.

Vacuum belt 60 is then reversed and sheet 58 moves rearwardly and downwardly to magnetic brush development station 62 according to the present invention. Station 62 includes applicator 64, magnetic developer supply 66, and conductive back-up roller or guide 67. A more detailed description of the structure and operation of development station 62 will be given below, but, in general, magnetic developer particles are deposited on applicator 64 from supply 66 and distributed over the surface of applicator 64 through the influence of a rotating magnetic field and through the influence of gravity to develop a latent electrostatic image on copy sheet 58 into a visible image of the microfilm image. Either negative to positive or positive to positive prints may be made. When negative to positive prints are made, applicator 64 is biased to the charge level of the latent electrostatic image to develop the background areas. When positive to positive prints are made, applicator 64 and sheet 58 are electrically connected to ground.

Sheet 58 carrying an unfused image is transported to a fuser apparatus which includes heated fuser roller 68 and pressure roller 69 held in pressure engagement to permanently fix the image to sheet 58 thus forming a finished print.

Thereafter, the finished print is delivered to receptacle 30 for removal by the operator.

It will be appreciated that the components of microfilm reader apparatus 10 of FIG. 2 are diagrammatically illustrated only. Distances between components of printer assembly 20 are shown farther apart than in actual practice, in order to more clearly illustrate the interrelationship of the several components. It will also be appreciated that apparatus 10 of FIG. 2 is oriented to fit into cabinet 14 of FIG. 1 so that the copy sheet path in print assembly 20 is transversely inclined to the horizontal.

Figure 3:
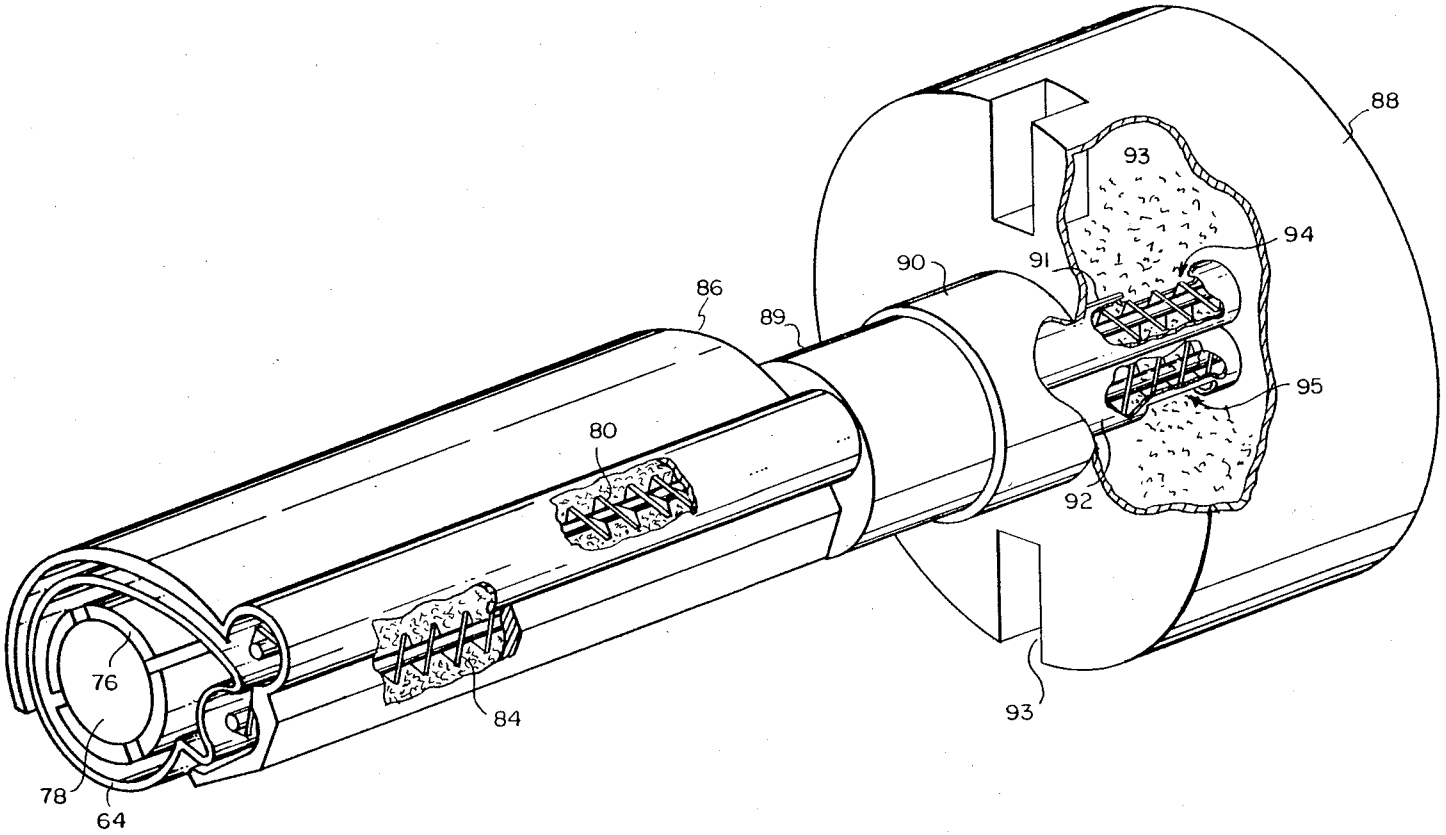
FIG. 3 is a partially-sectional diagrammatic perspective view of a preferred embodiment of magnetic brush development apparatus according to the present invention.
Figure 4:
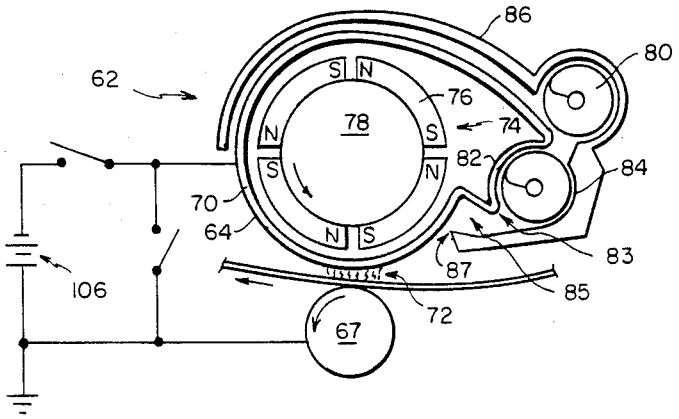
FIG. 4 is a diagrammatic rear elevational view of the apparatus of FIG. 3.
Figure 5:
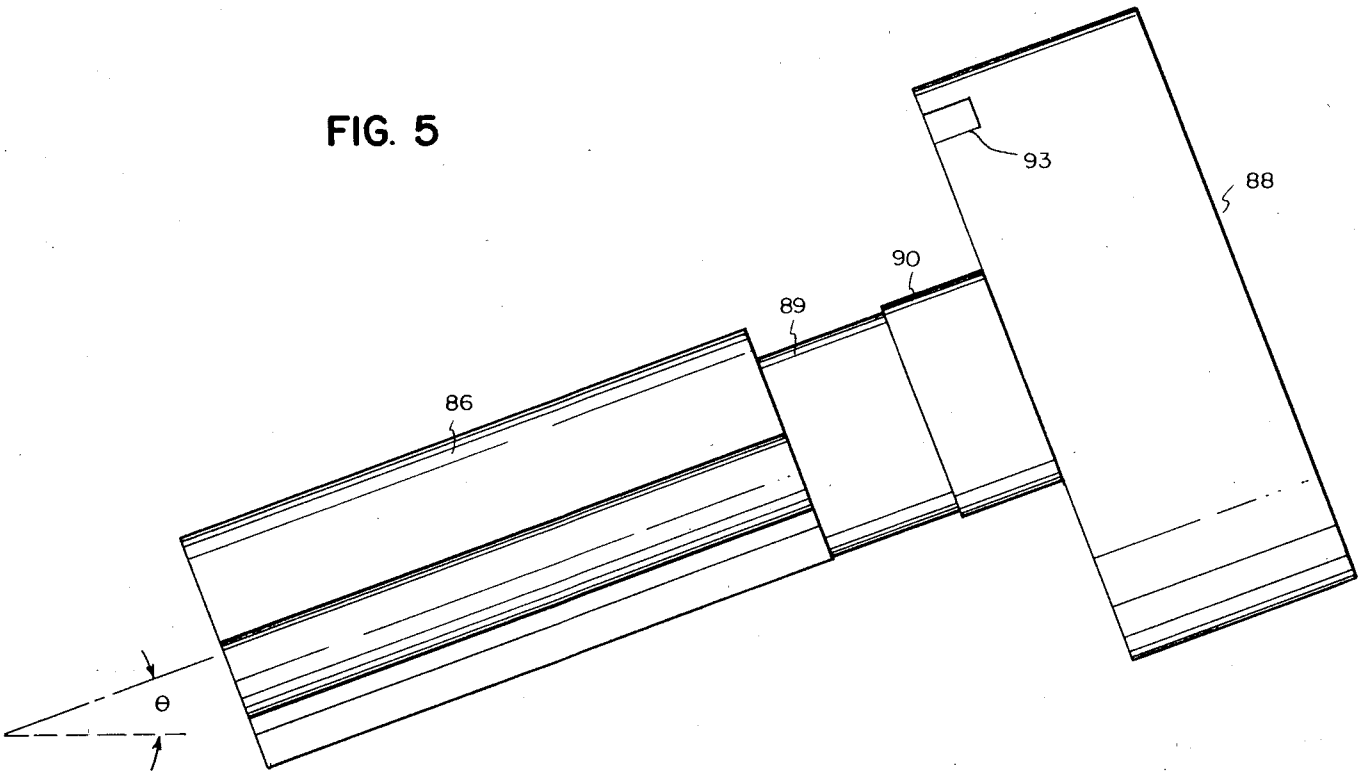
FIG. 5 is a diagrammatic side elevational view of the development apparatus of FIG. 3.

Referring now to FIGS. 3–5, there is shown a preferred embodiment of development apparatus according to the present invention. Development apparatus 62 is oriented at an angle $\theta$ of 10° or 20° to the horizontal since a support 58 carrying an electrostatic latent image is moved through a path which is transversely inclined to the horizontal at an angle of 10° or 20° and development apparatus 62 is adjacent to this path. It will be understood that apparatus 62 may be inclined at angles other than those enumerated. Development apparatus 62 provides fresh developer to replace that carried away during the development process and is specifically described utilizing a single-component, relatively electrically conductive magnetic developer which does not compact or clog the development apparatus as it is transported through the development cycle. It will be understood that insulating or more or less conductive developer may also be used. It will be understood that two-component developer may also be used in the development of electrostatic latent images by the apparatus of the present invention. The latent image to be developed also may be a magnetic image.

As shown, development apparatus 62 includes a stationary, non-magnetic applicator 64 of irregular peripheral shape having a segment 70 (FIG. 4) located adjacent to development zone 72 of printer apparatus 20. Zone 72 and applicator 64 are transversely inclined to the horizontal at a predetermined angle of about 20°.

Rotatably mounted within applicator 64 is a magnet assembly 74 including a plurality of magnets 76 mounted on core 78.

Figure 6:
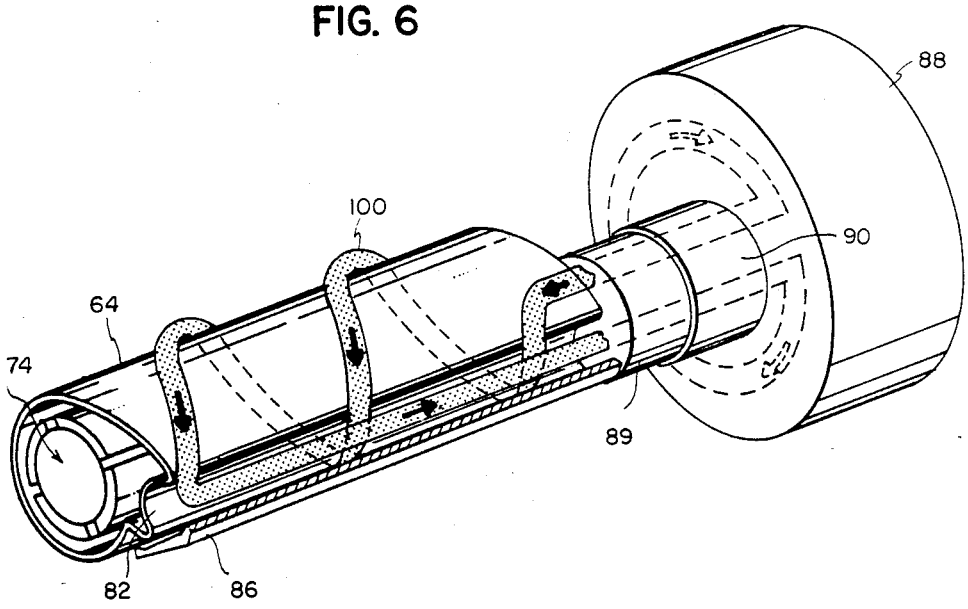
FIG. 6 is a diagrammatic perspective view of the path of developer in the development apparatus of FIG. 3.

Disposed adjacent to applicator 64 is infeed auger 80 which supplies single-component magnetic developer from a cylindrical supply bottle 88 to the upper end of applicator 64. As magnet assembly 74 rotates in the counterclockwise direction as shown in FIG. 3, and as magnetic developer is fed by auger 80 to the upper end of inclined applicator 64 (the right end as shown in FIG. 5) magnetic developer will be distributed throughout the surface of applicator 64 through the influence of gravity and through the influence of magnetic assembly 74 on the magnetic developer which moves it in a clockwise direction about the periphery of applicator 64. Applicator 64 has an asymmetrical peripheral shape such that magnetic assembly 74 has greater magnetic influence on magnetic developer in regions of applicator 64 closely spaced to magnets 76 such as in development zone 72 and in zones after the development zone. In these zones the magnetic developer tends to be moved by magnetic assembly 74 less obliquely in a more circumferential arc about applicator 64. However, where the surface of applicator 64 is spaced farther from magnets 76, the magnetic influence is substantially less and magnetic developer is more influenced by gravity to move laterally down inclined applicator 64 in a more oblique path. These influences are illustrated in FIG. 6, where developer is shown as following a spiral path 100 about applicator 64.

Applicator 64 has a recessed segment 82 which partially surrounds a return auger 84 which extends the length of applicator 64. Auger 84 is disposed at the inlet 83 to a reservoir 85 which is formed by a segment of applicator 64 and the lower end of cover member 86. Member 86 is of non-conductive, non-magnetic material and substantially surrounds applicator 64 and encloses augers 80 and 84.

Edge 87 of member 86 is spaced a predetermined distance from applicator 64 and acts to level the developer moved about the periphery of applicator 64 to a uniform height so that it is applied evenly to a support 58 carrying a developable latent image moved through development zone 72.

Edge 87 consists of a conductive metal bar, or bars, isolated from applicator 64. The magnetic fields set up in edge 87 by the rotating magnets 76 cause the magnetic developer to jump back and forth between applicator 64 and edge 87, keeping the magnetic toner fluffy and free to move.

Cylindrical developer supply bottle 88 is rotatably mounted on cylindrical extension 89 of cover member 86 by means of neck 90. Augers 80 and 84 extend through developer transport tubes 91 and 92, respectively, which are supported by extension 89 and which are aligned with transport channels formed by applicator 64 and cover member 86. Bottle 88 is provided with scoops 93 which scoop up developer at the bottom of rotation and carry it around to deposit it by gravity in opening 94 at the end of tube 91. When the end of tube 91 is full, excess developer falls back to the bottom of bottle 88. Excess toner carried off applicator 64 by return auger 84 is fed through opening 95 in tube 92 to bottle 88.

As seen in FIG. 6, developer is continually agitated and is continuously recirculated along a path such as path 100 from bottle 88 onto applicator 64 by auger 80, around applicator 64 through development zone 72 through the influence of rotating magnetic assembly 74 and of gravity and back up applicator 64 to bottle 88 by auger 84. This recirculation system minimizes compaction of developer within bottle 88 and minimizes clotting of developer during its movement about applicator 64.

Figure 7:
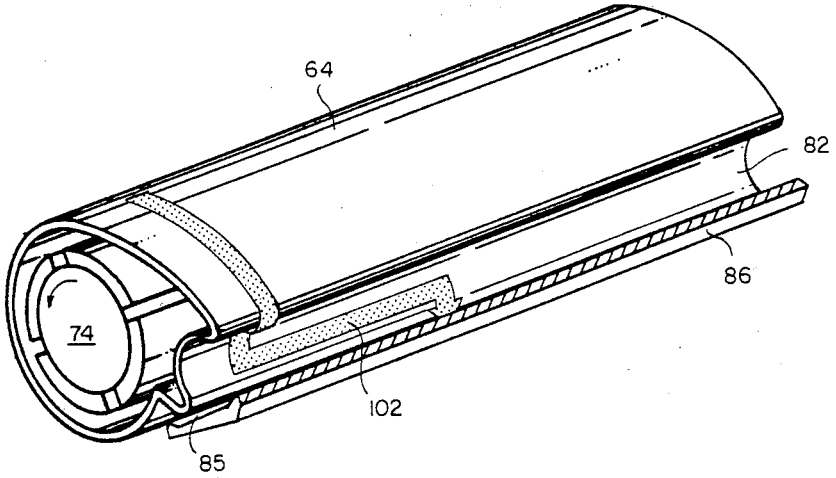
FIGS. 7 and 8 are partially sectional diagrammatic perspective views of part of the apparatus of FIG. 3 respectively showing developer being transported up the applicator and filling in an area of the reservoir which is depleted of developer and showing developer being transported up the applicator and off the upper end thereof when the reservoir is full along its length.
Figure 8:
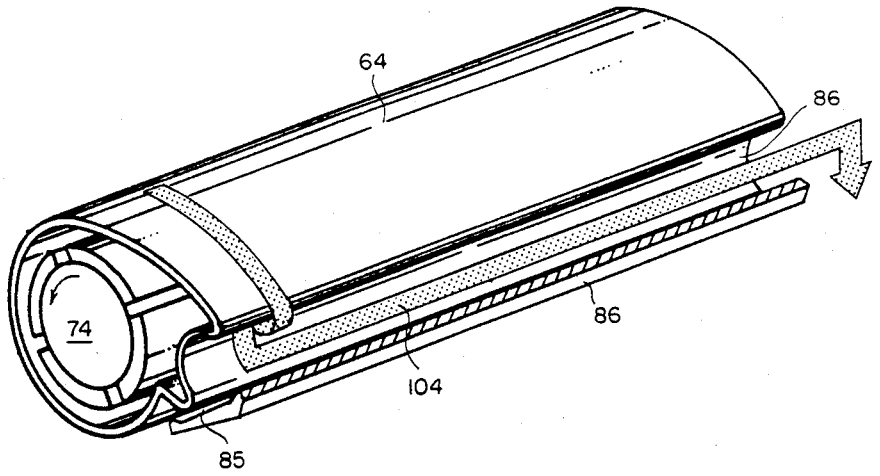

As shown in FIGS. 7 and 8, as unused developer is returned from development zone 72, it will be moved into reservoir 85. If reservoir 85 is full, auger 84 will move developer back up applicator 64 in recess 82 (e.g., along path 102) until an area of inlet 83 showing a deficiency in reservoir 85 is open to receive it (FIG. 7). If inlet 83 to reservoir 85 is full along its length, auger 84 will move developer up the length of applicator 64 (e.g., along path 104) through tube 92 and back into bottle 88 through opening 95.

Preferably, applicator 64 is electrically conductive, and the developer is relative conductive. Then, a source 106 (FIG. 4) of electrical potential applied between guide or roller 67 and applicator 64 will induce a flow of electrical current through the developer to effect development of a latent electrostatic image on support 58. When negative to positive prints are made, applicator 64 is biased to the charge level of the latent electrostatic image to develop the background areas. When positive to positive prints are made, applicator 64 and guide or roller 67 are connected to ground.

It will be understood that if the developer is non-conductive, applicator 64 may also be non-conductive.

The invention has been described in detail with particular reference to a preferred embodiment thereof, but it will be understood that variations and modifications can be effected within the spirit and scope of the invention as described hereinabove and as defined in the appended claims.

What is claimed is:

1. In reproduction apparatus in which a support carrying a latent image is moved through a development zone which is transversely inclined at a predetermined angle to the horizontal, development apparatus comprising:

a stationary non-magnetic applicator having a segment located adjacent to said development zone and oriented at said predetermined angle to the horizontal;

supply means for supplying magnetic developer to said applicator at a supply zone spaced from said development zone, said developer being influenced by gravity to move down said inclined applicator;

magnet means rotatably mounted within said applicator for moving said magnetic developer about the periphery of said applicator through said development zone, said developer being distributed over the surface of said applicator through the influence of said magnet means and through the influence of gravity;

reservoir means associated with said applicator and located between said supply zone and said development zone for accumulating developer moved about said applicator and for leveling the developer to produce a uniformly thick layer in said development zone; and means associated with said applicator and positioned at the inlet to said reservoir means for transporting excess developer from said reservoir means back up said applicator against the influence of gravity to deposit developer in said reservoir means in areas which are deficient in developer and to remove excess developer from said applicator at the upper end thereof when the reservoir means is full.

2. The invention of claim 1 including means for recycling developer removed from said applicator back to said supply zone.

3. The invention of claim 1 wherein said supply means supplies single-component magnetic developer to said applicator and wherein a support carrying a latent magnetic image is moved through said development zone to be developed by said single-component magnetic developer.

4. The invention of claim 1 wherein said supply means supplies single-component relatively electrically conductive, magnetic developer to said applicator, wherein said applicator is electrically conductive, and wherein a support carrying a latent electrostatic image moved through said development zone is electrically connected to said applicator to effect development of said electrostatic image by said developer.

5. The invention of claim 1 wherein said supply means supplies to said applicator developer including magnetic carrier and electrostatically charged toner and wherein a support carrying a latent electrostatic image is moved through said development zone to be developed with said electrostatically charged toner.

6. The invention of claim 1 wherein said applicator has an irregular peripheral shape with zones of strong and weak magnetic influence and wherein said developer tends to be influenced more by gravity in said weak magnetic zones to be moved laterally down said inclined applicator in said zones.

7. The invention of claim 1 wherein said supply means supplies single-component, electrostatically charged, insulating magnetic developer to said applicator and wherein a support carrying a latent electrostatic image is moved through said development zone to be developed with said developer.

8. In electrographic apparatus in which a support carrying a latent image is moved through a development zone which is transversely inclined at a predetermined angle to the horizontal, development apparatus comprising:

a stationary non-magnetic applicator having a segment located adjacent to said development zone and oriented at said predetermined angle to the horizontal;

supply means for supplying a single-component magnetic developer at the upper end of said applicator at a supply zone thereof spaced from said development zone, said developer being influenced by gravity to move down said inclined applicator;

a magnet assembly mounted for rotation within said applicator to cause said magnetic developer to move along said applicator through said development zone;

means forming with said applicator a reservoir located between said supply zone and said development zone for accumulating developer moved along said applicator, said reservoir having an inlet and an outlet;

a toner leveler located at the outlet of said reservoir for producing a substantially uniformly thick layer of developer in said development zone; and means located at the inlet to said reservoir for transporting excess developer from said reservoir back up said applicator against the influence of gravity to deposit developer in said reservoir in areas which are deficient in developer and to remove excess developer from the upper end of the applicator when the reservoir is full.

9. The invention of claim 8 wherein said applicator is inclined at a predetermined angle of 10°–20° to the horizontal.

10. The invention of claim 8 wherein said applicator is electrically conductive, wherein said supply means supplies single-component, relatively electrically conductive magnetic developer to said applicator and wherein a support carrying a latent electrostatic image moved through said development zone is electrically connected to said applicator to effect development of said electrostatic image.

11. The invention of claim 10 wherein a support carrying an electrostatic image at a first electrical potential and having background areas at a second electrical potential is moved through said development zone and wherein an electrical potential is applied between said applicator and said support substantially equal to the electrical potential of said electrostatic image to effect development of said background areas.

12. The invention of claim 8 wherein said supply means includes an infeed auger for feeding magnetic developer to the upper end of said applicator.

13. The invention of claim 8 wherein said transporting means includes an auger extending the length of said applicator and wherein said applicator is recessed adjacent said auger to enclose a portion of said auger.

* * * * *